US010099823B2

(12) United States Patent
Kawamura

(10) Patent No.: US 10,099,823 B2
(45) Date of Patent: Oct. 16, 2018

(54) VIAL CAP

(71) Applicant: DAIKYO SEIKO, LTD., Tochigi (JP)

(72) Inventor: Hideaki Kawamura, Tochigi (JP)

(73) Assignee: DAIKYO SEIKO, LTD., Tochigi (JP)

( * ) Notice: Subject to any disclaimer, the term of this patent is extended or adjusted under 35 U.S.C. 154(b) by 0 days.

(21) Appl. No.: 15/518,150

(22) PCT Filed: Nov. 9, 2015

(86) PCT No.: PCT/JP2015/081490
§ 371 (c)(1),
(2) Date: Apr. 10, 2017

(87) PCT Pub. No.: WO2016/080231
PCT Pub. Date: May 26, 2016

(65) Prior Publication Data

US 2017/0297781 A1 Oct. 19, 2017

(30) Foreign Application Priority Data

Nov. 18, 2014 (JP) ..... 2014-233411

(51) Int. Cl.
*B65D 41/58* (2006.01)
*B65D 51/18* (2006.01)
(Continued)

(52) U.S. Cl.
CPC ..... *B65D 41/58* (2013.01); *A61J 1/1412* (2013.01); *A61J 1/1425* (2015.05); *B65D 41/62* (2013.01); *B65D 51/18* (2013.01); *A61J 1/06* (2013.01)

(58) Field of Classification Search
CPC ..... B65D 41/32–41/58; B65D 41/62; A61J 1/05–1/1412
(Continued)

(56) References Cited

U.S. PATENT DOCUMENTS 6,635,043 B2 * 10/2003 Daubert ..... A61J 1/2096 215/247
2011/0266249 A1 * 11/2011 Kakutani ..... B65D 51/002 215/364
(Continued)

FOREIGN PATENT DOCUMENTS

JP 03-505320 11/1991
JP 08-299412 11/1996
JP 2012-106763 6/2012

OTHER PUBLICATIONS

International Search Report, issued in the corresponding PCT application No. PCT/JP2015/081490, dated Dec. 8, 2015, 3 pages.
(Continued)

*Primary Examiner* — Kareen Thomas
(74) *Attorney, Agent, or Firm* — Hamre, Schumann, Mueller & Larson, P.C.

(57) ABSTRACT

There is provided a vial cap with which, when there is a possibility that a cover which covers a stopper for a vial has come off and the stopper for the vial has been contaminated at a stage prior to use, the fact can easily be recognized. The vial cap is a resin vial cap (1) to be attached to a mouth portion (72) of a vial (70) to fix a stopper (74) fitted into the mouth portion (72) so that the stopper may not come off the mouth portion (72). The vial cap (1) is provided with a cap main body (8) that has an upper opening (6) formed therein and a cover (40) that covers the upper opening (6) of the cap main body (8). The cap main body (8) has a plurality of pin-receiving holes (10) formed therein, and the cover (40) has a plurality of fixing pins (46). Each pin-receiving hole (10) and a fixing pin (46) that is paired with the pin-receiving hole (10) are formed in complementary shapes. The plurality of fixing pins (46) of the cover (40) are accommodated in the plurality of pin-receiving holes (10) of the cap main body (8), and the cap main body (8) and the
(Continued)

cover (40) are joined with the pin-receiving holes (10) and the fixing pins (46) engaged.

11 Claims, 16 Drawing Sheets

(51) Int. Cl.
*A61J 1/14* (2006.01)
*B65D 41/62* (2006.01)
*A61J 1/06* (2006.01)

(58) Field of Classification Search
USPC .... 215/307–316, 50, 54, 294–300, 320, 355
See application file for complete search history.

(56) References Cited

U.S. PATENT DOCUMENTS

| | | | | |
|---|---|---|---|---|
| 2012/0118894 | A1 | 5/2012 | Kawamura et al. | |
| 2012/0160850 | A1* | 6/2012 | Gelibert | B65D 55/063 220/320 |
| 2012/0248057 | A1* | 10/2012 | Bogle | A61J 1/1406 215/43 |
| 2012/0305519 | A1* | 12/2012 | Lee | B65D 51/2835 215/316 |
| 2014/0042163 | A1 | 2/2014 | Waeben et al. | |

OTHER PUBLICATIONS

Extended European Search Report, issued in the corresponding European Patent Application No. EP 15861429.7 dated May 24, 2018, 7 pages.

* cited by examiner

[Figure 1]
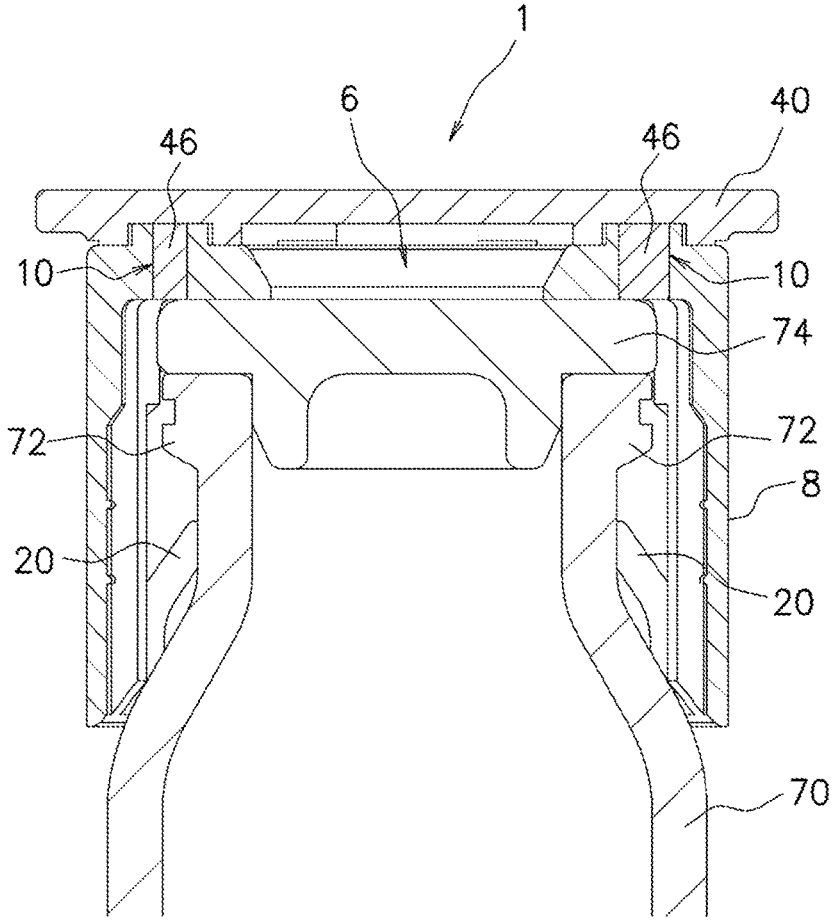

[Figure 2A]
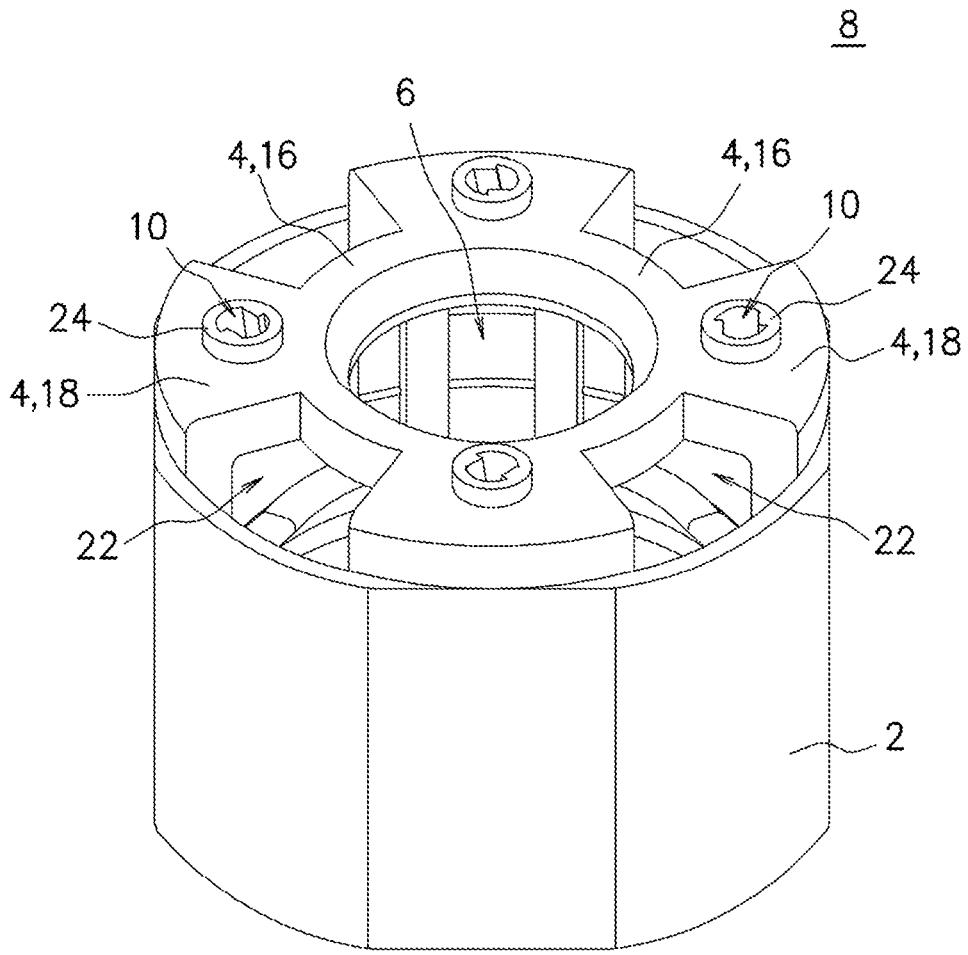

[Figure 2B]
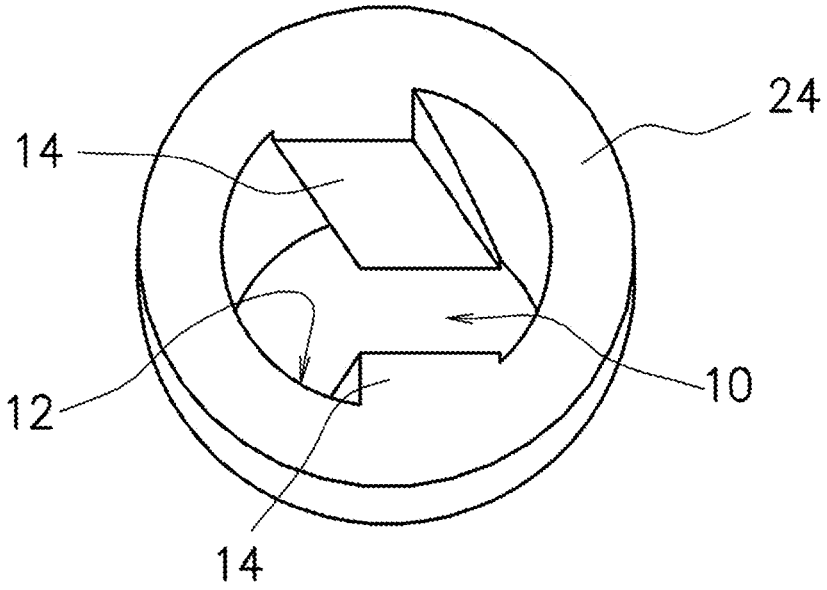

[Figure 2C]
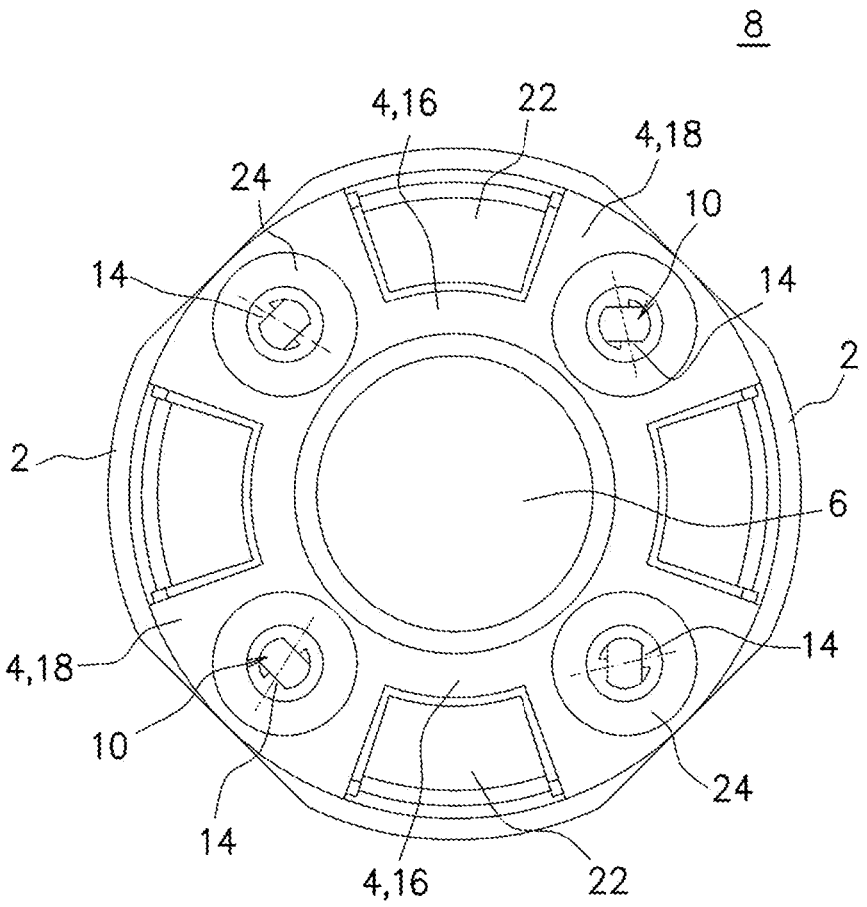

[Figure 3A]
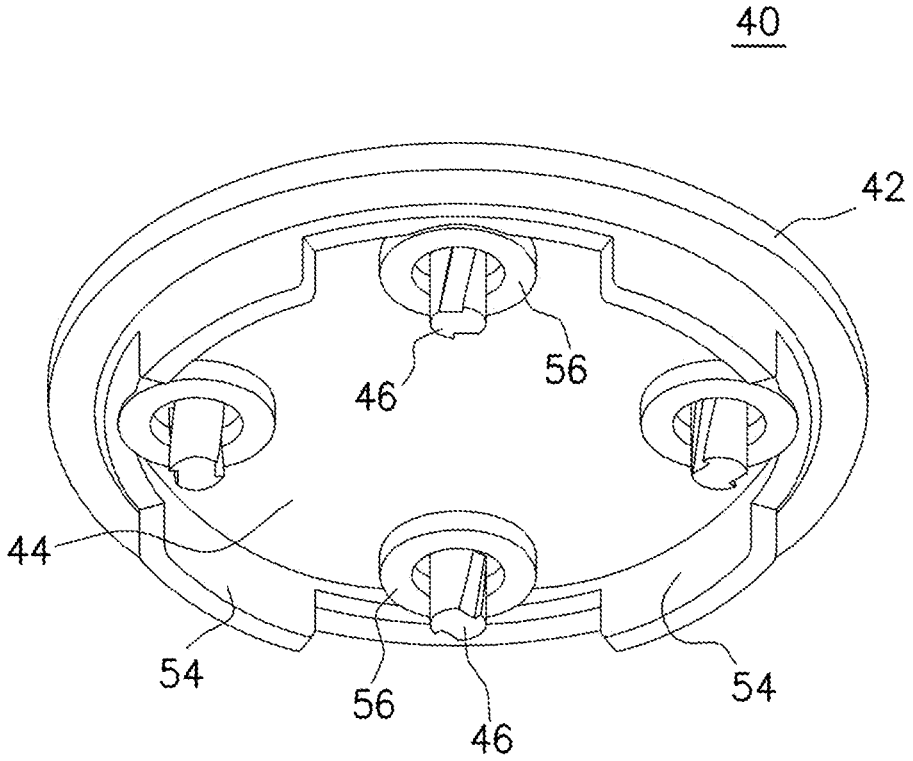

[Figure 3B]
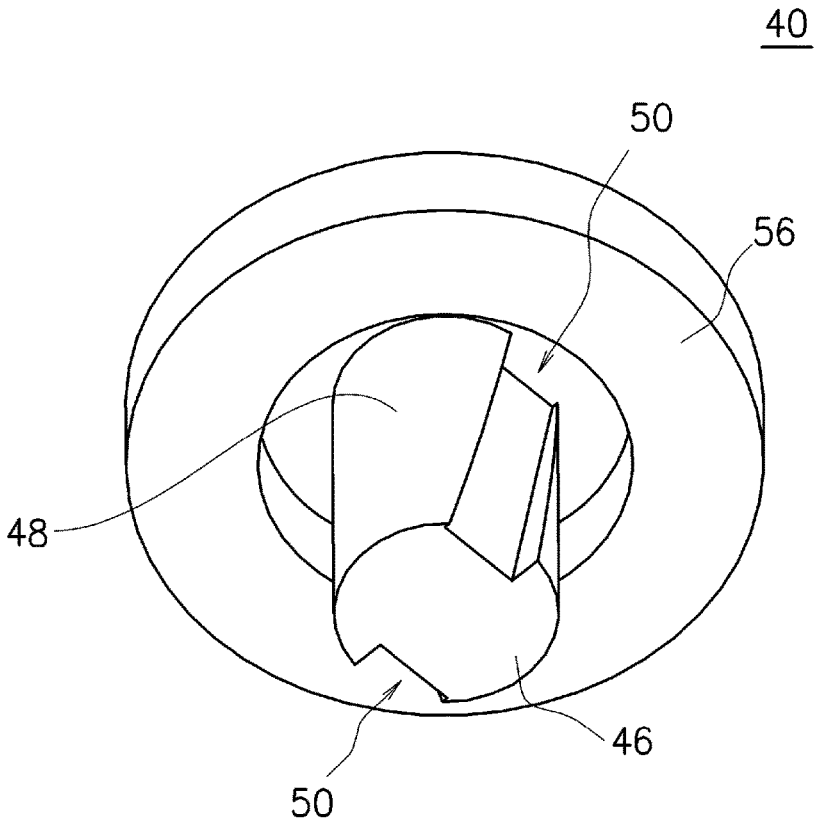

[Figure 3C]
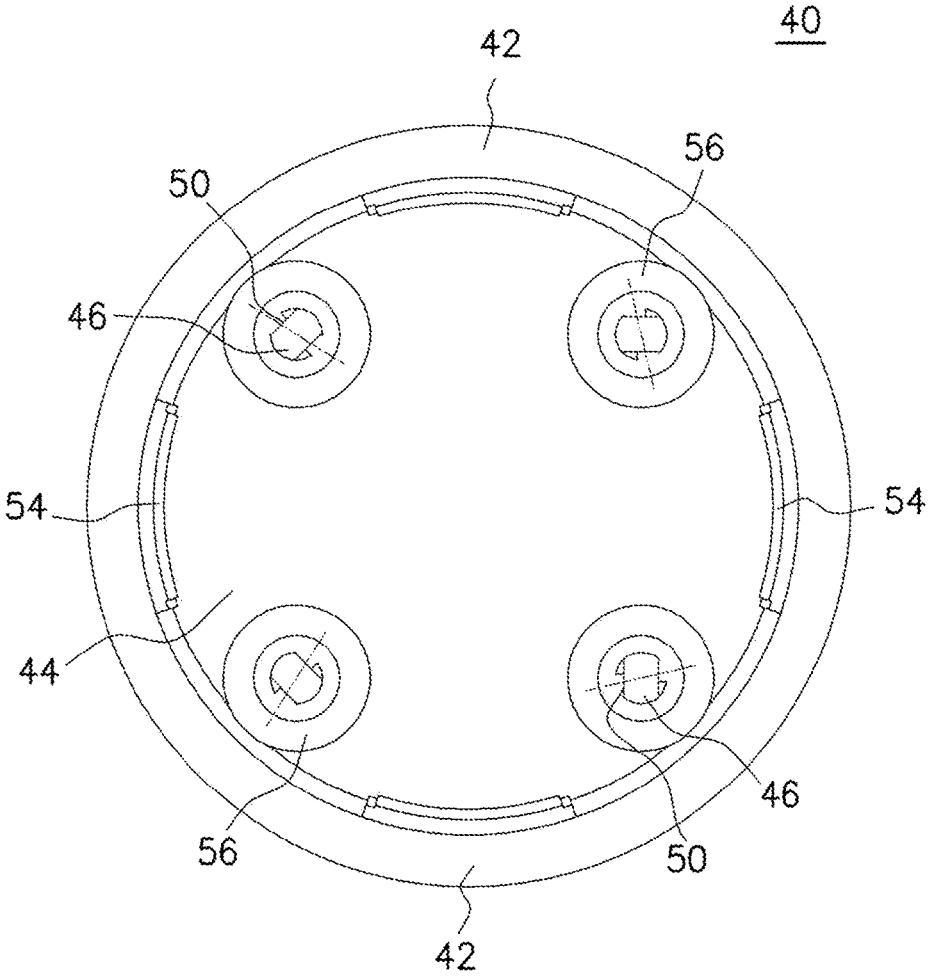

[Figure 4]
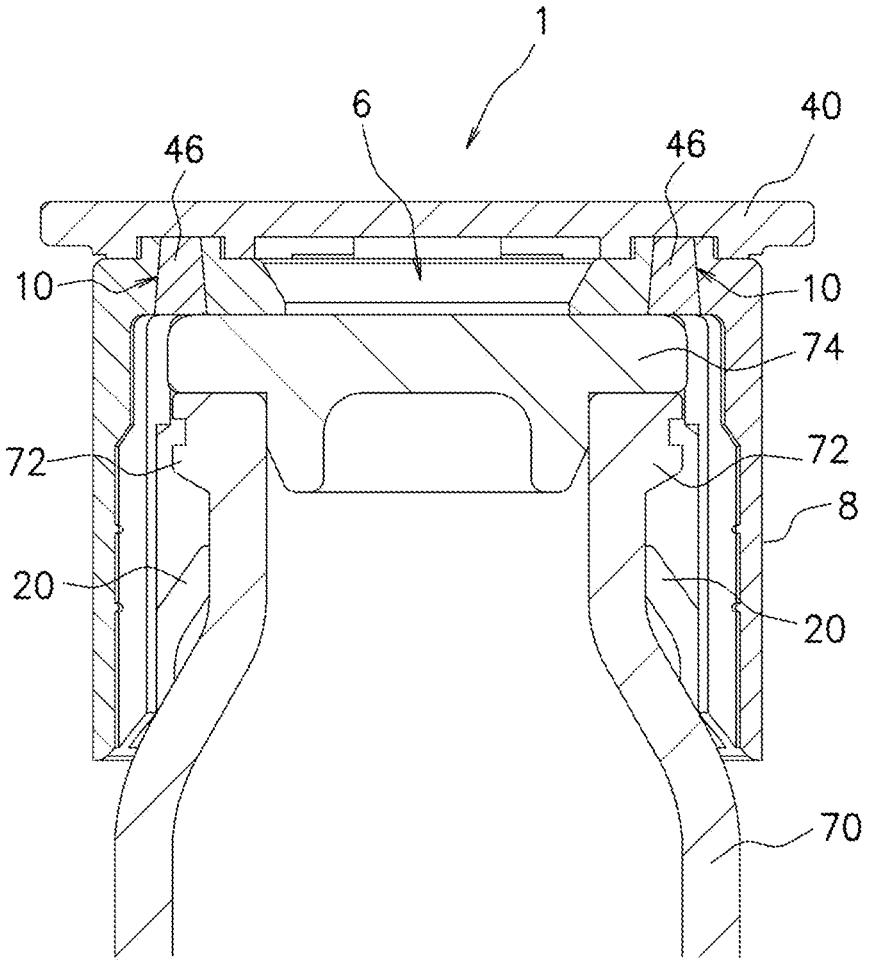

[Figure 5A]
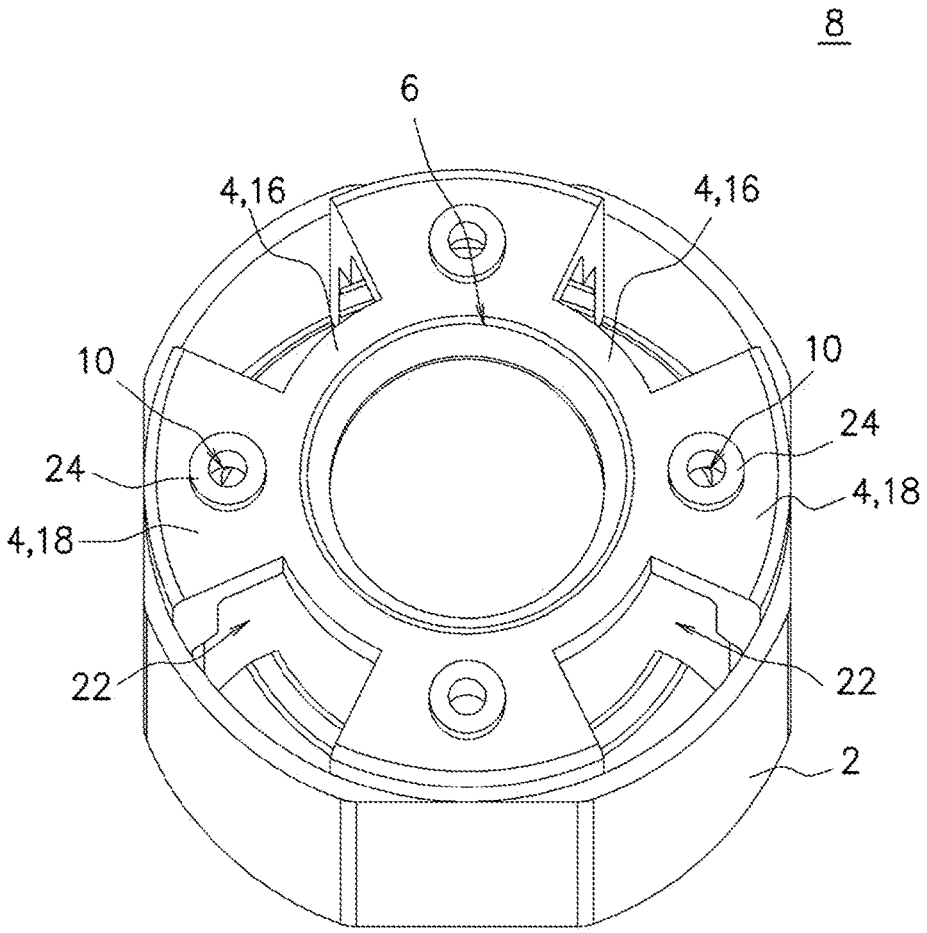

[Figure 5B]
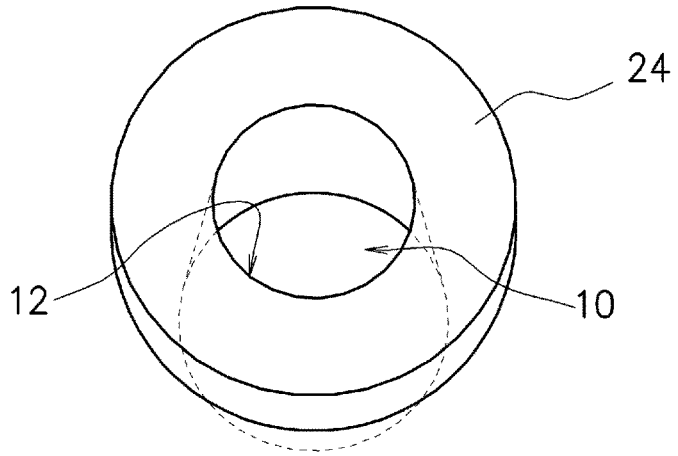
[Figure 6A]
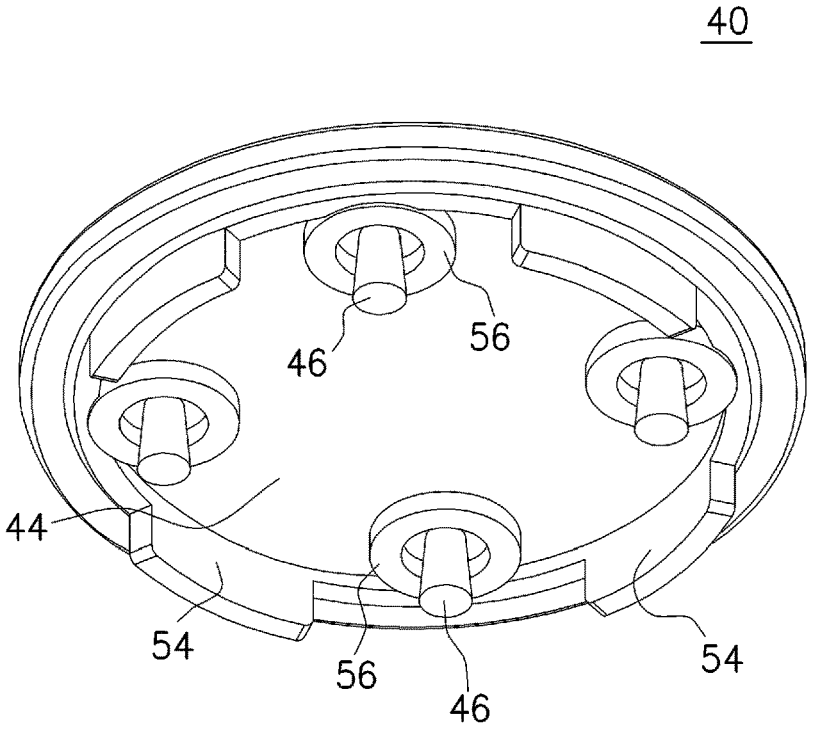

[Figure 6B]
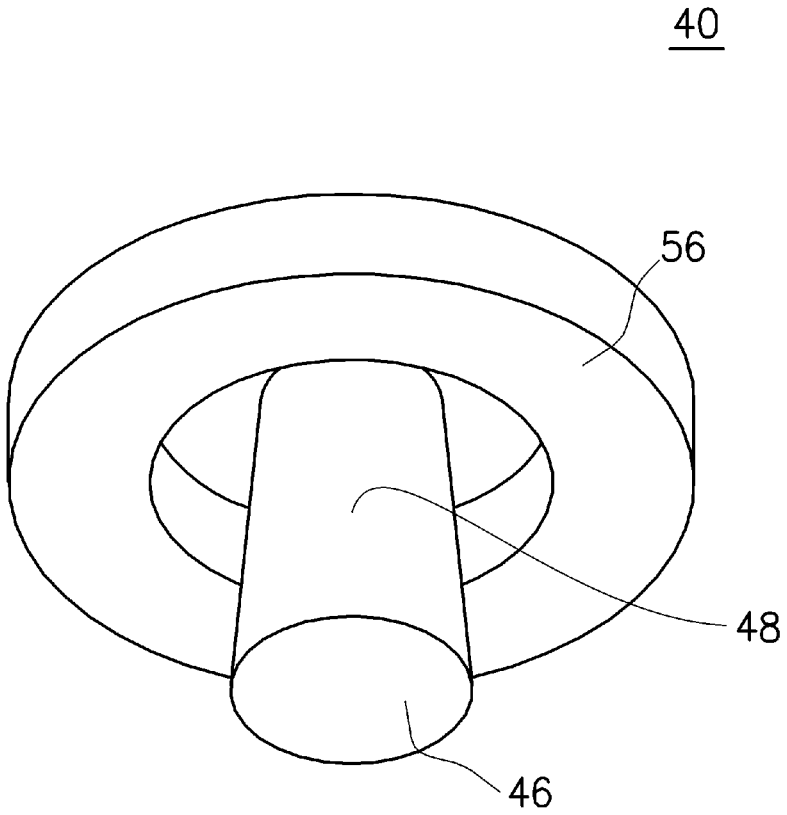

[Figure 7A]
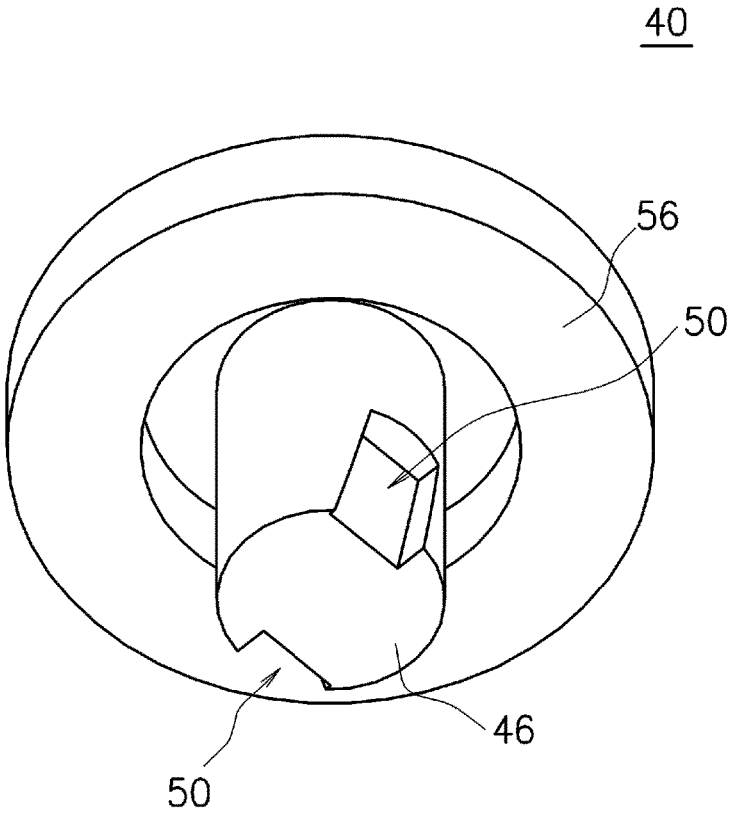

[Figure 7B]
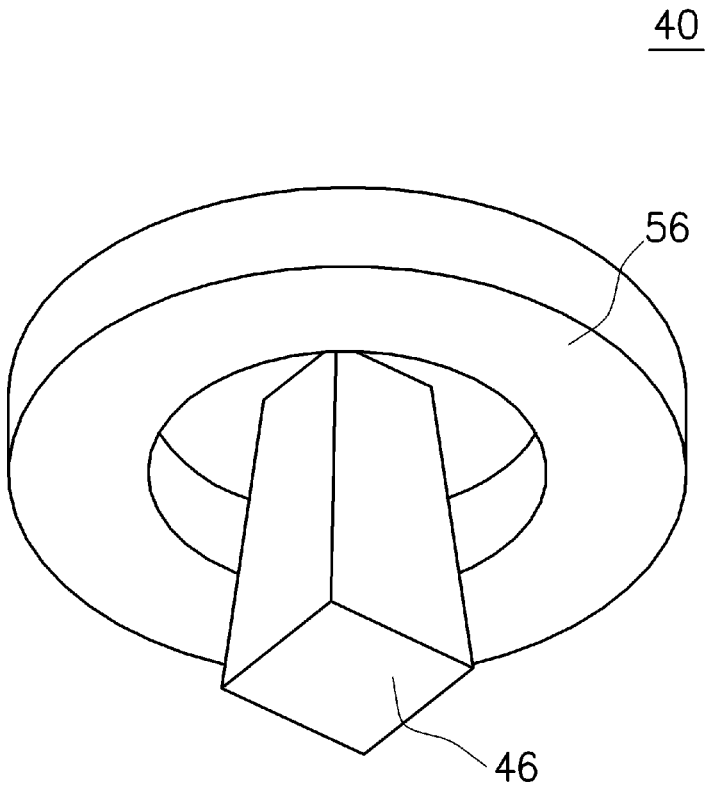

[Figure 7C]
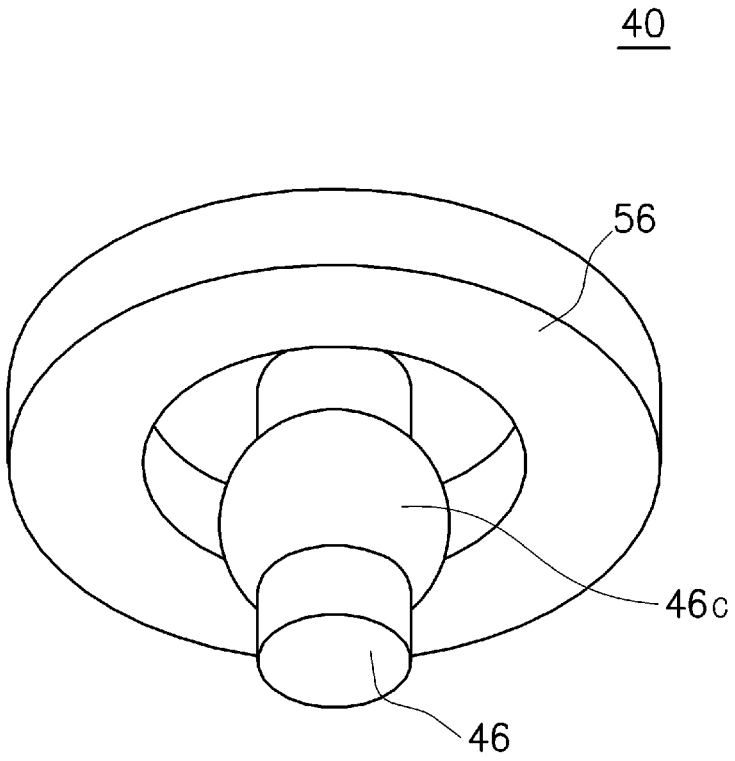

[Figure 7D]
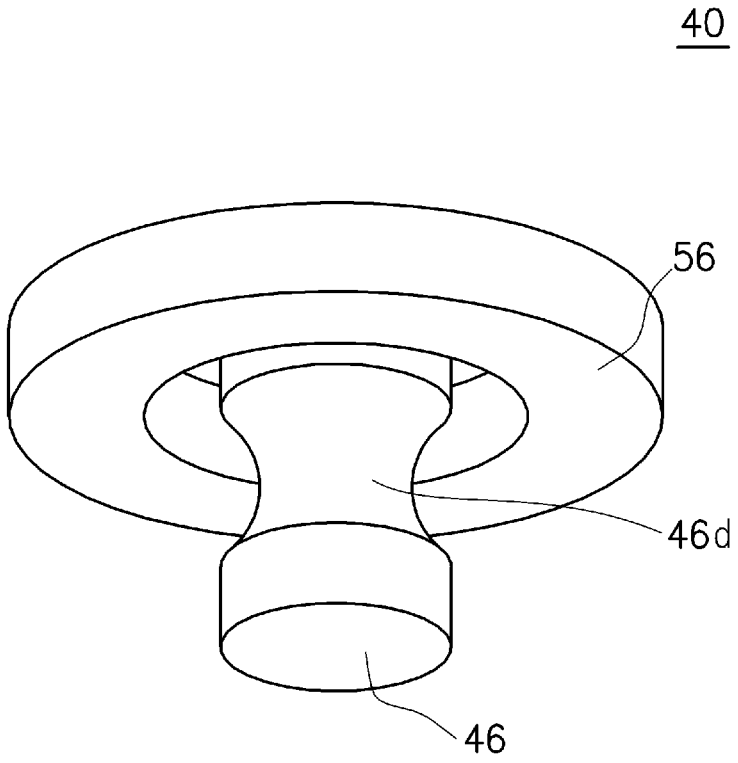

[Figure 7E]
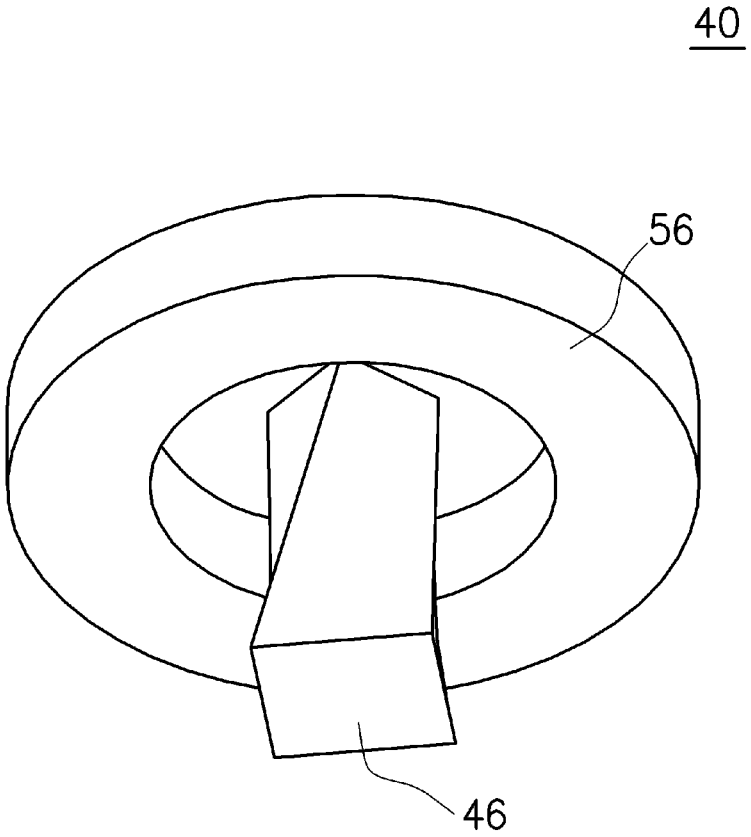

VIAL CAP

TECHNICAL FIELD

The present invention relates to a vial cap.

BACKGROUND ART

A vial is a sealed container for accommodating a pharmaceutical product or the like. The vial can be sealed by fitting a stopper (rubber stopper or the like) made of an elastic material into a mouth portion of the vial after filling a pharmaceutical product or the like inside the vial. Moreover, when an injection solution or a transfusion preparation is accommodated inside the vial, a parenteral injection can be transferred into an injector through an injection needle or the transfusion preparation can be used as it is for transfusion through a spike needle (bottle needle) with the stopper fitted into the mouth portion (namely, without removing the stopper) by piercing the injection needle or the spike needle through the stopper.

The sealing state of a vial needs to be maintained surely by fixing the stopper so as not to come off the mouth portion from the viewpoint of quality assurance and safety of pharmaceutical products and the like. Moreover, with respect to the vial used for parenteral injections or transfusion, it is necessary to prevent as much as possible a situation that the stopper is contaminated at a stage prior to use such as a stage in the distribution process, while a structure by which the stopper can easily be exposed at the time of use is necessary.

Thus, there is proposed a cap to be attached to the mouth portion to fix a stopper fitted into the mouth portion of a vial so that the stopper may not come off the mouth portion. Conventionally, aluminum caps have generally been used as such a cap (vial cap); however, resin caps have also been proposed recently. For example, there is proposed a plastic cap including: a cap main body provided with a window portion at the center portion of a top board; and a lid portion covering the window portion, in which plastic for welding is filled in a hole for welding which is formed in the cap main body, and the cap main body and the lid portion are welded and integrated by the filled plastic for welding (see Patent Literature 1).

CITATION LIST

Patent Literature

Patent Literature 1: Japanese Patent Laid-Open No. 2012-106763

SUMMARY OF INVENTION

Technical Problem

The cap described in Patent Literature 1 can fix the stopper, which is fitted into the mouth portion, so as not to come off the mouth portion by engaging a claw portion provided in the inner circumferential surface of the cap main body with the mouth portion (ring-shaped lip) of the vial. Moreover, the cap described in Patent Literature 1 can prevent a situation that the stopper is contaminated in the distribution process or the like because the stopper is covered by the lid portion at a stage prior to use. Furthermore, with respect to the cap described in Patent Literature 1, the lid portion can be detached at the time of use from the cap main body by breaking by hand the plastic portion for welding, which welds and integrates the cap main body and the lid portion, and the stopper can easily be exposed through the window portion of the cap main body. Accordingly, it can be said that the cap described in Patent Literature 1 is extremely excellent in that the cap can prevent coming-off of a stopper and contamination of the stopper before use, and the stopper can easily be exposed by removing the lid portion at the time of use.

However, for example, in the cap described in Patent Literature 1, if the lid portion comes off unintentionally or is intentionally detached from the cap main body, there is a possibility that the stopper for the vial is contaminated. When the lid portion (cover) that has once come off (or has once been detached) is attached to the cap main body again, caps may exist with which it becomes difficult to grasp at the time of use the fact that the cover has come off (or has been detached) or the fact that the stopper has been contaminated. Since the level of product quality and safety required for pharmaceutical products and the like is extremely high, it is desired that the fact that the lid portion has come off (or has been detached) or the fact that the stopper has been contaminated be easily grasped.

Thus, the present invention intends to provide a resin vial cap: which can prevent coming-off of a stopper for a vial and contamination of the stopper; with which the stopper for the vial can easily be exposed at the time of use; and with which, when there is a possibility that a cover has come off (or has been detached from) a cap main body and the stopper for the vial has been contaminated at a stage prior to use, the fact can easily be recognized.

Solution to Problem

According to the present invention, there is provided a resin vial cap to be attached to a mouth portion of a vial to fix a stopper fitted into the mouth portion so that the stopper may not come off the mouth portion, the resin vial cap including: a cap main body; and a cover, the cap main body having: a top face portion formed at an upper end of a tubular portion; an upper opening formed at the center of the top face portion and penetrating the top face portion; and a plurality of pin-receiving holes formed at the top face portion and penetrating the top face portion, and the cover covering the upper opening of the cap main body and having: a plate-shaped cover main body; and a plurality of fixing pins protruding downward from a lower face of the cover main body, in which: the pin-receiving holes of the cap main body and the fixing pins of the cover are paired and each pin-receiving hole and a fixing pin paired with the pin-receiving hole are formed in complementary shapes; and the plurality of fixing pins of the cover are accommodated in the plurality of pin-receiving holes of the cap main body, and the cap main body and the cover are joined with the pin-receiving holes and the fixing pins engaged.

Advantageous Effects of Invention

With a vial cap according to the present invention, coming-off of a stopper for a vial and contamination of the stopper can be prevented, and the stopper can easily be exposed at the time of use. Moreover, when there is a possibility that a cover has come off (or has been detached from) a cap main body and the stopper for the vial has been contaminated at a stage prior to use, the fact can easily be recognized.

BRIEF DESCRIPTION OF DRAWINGS

FIG. 1 illustrates an embodiment of a vial cap according to the present invention and is an enlarged sectional view schematically illustrating a state in which the vial cap is attached to a mouth portion of a vial into which a stopper is fitted.

FIG. 2A is a perspective view schematically illustrating a cap main body portion of the vial cap illustrated in FIG. 1 by enlarging the cap main body portion.

FIG. 2B is a perspective view schematically illustrating a pin-receiving hole portion of the cap main body illustrated in FIG. 2A by enlarging the pin-receiving hole portion.

FIG. 2C is a plan view schematically illustrating a disposition of screw threads of respective pin-receiving holes of the cap main body illustrated in FIG. 2A.

FIG. 3A is a perspective view schematically illustrating a cover portion of the vial cap illustrated in FIG. 1 by enlarging the cover portion.

FIG. 3B is a perspective view schematically illustrating a fixing pin portion of the cover illustrated in FIG. 3A by enlarging the fixing pin portion.

FIG. 3C is a plan view schematically illustrating a disposition of screw grooves of respective fixing pins of the cover illustrated in FIG. 3A.

FIG. 4 illustrates another embodiment of a vial cap according to the present invention and is an enlarged sectional view schematically illustrating a state in which the vial cap is attached to a mouth portion of a vial into which a stopper is fitted.

FIG. 5A is a perspective view schematically illustrating a cap main body portion of the vial cap illustrated in FIG. 4 by enlarging the cap main body portion.

FIG. 5B is a perspective view schematically illustrating a pin-receiving hole portion of the cap main body illustrated in FIG. 5A by enlarging the pin-receiving hole portion.

FIG. 6A is a perspective view schematically illustrating a cover portion of the vial cap illustrated in FIG. 4 by enlarging the cover portion.

FIG. 6B is a perspective view schematically illustrating a fixing pin portion of the cover illustrated in FIG. 6A by enlarging the fixing pin portion.

FIG. 7A is a perspective view schematically illustrating a fixing pin portion of a cover by enlarging the fixing pin portion.

FIG. 7B is a perspective view schematically illustrating a fixing pin portion of a cover by enlarging the fixing pin portion.

FIG. 7C is a perspective view schematically illustrating a fixing pin portion of a cover by enlarging the fixing pin portion.

FIG. 7D is a perspective view schematically illustrating a fixing pin portion of a cover by enlarging the fixing pin portion.

FIG. 7E is a perspective view schematically illustrating a fixing pin portion of a cover by enlarging the fixing pin portion.

DESCRIPTION OF EMBODIMENTS

Hereinafter, embodiments according to the present invention will be described; however, the present invention is not limited to the following embodiments.

A vial cap according to an embodiment of the present invention is a resin vial cap to be attached to a mouth portion of a vial to fix a stopper fitted into the mouth portion so that the stopper may not come off the mouth portion. The vial cap includes: a cap main body having a top face portion formed at the upper end of a tubular portion and an upper opening formed at the center of the top face portion and penetrating the top face portion; and a cover covering the upper opening of the cap main body. The cap main body has a plurality of pin-receiving holes formed at the top face portion and penetrating the top face portion. The cover has: a plate-shaped cover main body; and a plurality of fixing pins protruding downward from a lower face of the cover main body. The pin-receiving holes of the cap main body and the fixing pins of the cover are paired and each pin-receiving hole and a fixing pin paired with the pin-receiving hole are formed in complementary shapes. In this vial cap, the plurality of fixing pins of the cover are accommodated in the plurality of pin-receiving holes of the cap main body, and the cap main body and the cover are joined with the pin-receiving holes and the fixing pins engaged.

In the vial cap according to the present embodiment, the upper opening penetrating the top face portion is formed at the center of the tope face portion of the cap main body and the cover covering the upper opening is provided, so that the cover can prevent coming-off of a stopper and contamination of the stopper before use. Moreover, a portion of the stopper can be exposed at the upper opening by removing the cover at the time of use.

In the vial cap according to the present embodiment, the pin-receiving holes and the fixing pins are formed in complementary shapes and the cap main body and the cover are joined with the pin-receiving holes and the fixing pins engaged, and therefore the cap main body and the cover can firmly be joined. Accordingly, a situation in which the cover comes off the cap main body unintentionally at a stage prior to use can effectively be prevented, and coming-off of the stopper for the vial and contamination of the stopper can effectively be prevented. Furthermore, the pin-receiving holes and fixing pins are engaged due to their complementary shapes, the fixing pins are easy to tear off or fracture when the cover comes off the cap main body. Moreover, even if the fixing pins come off the pin-receiving holes without being torn off (without being fractured), it is difficult to attach the fixing pins which have once come off to the pin-receiving holes again. In this way, the trace that the cover has come off the cap main body is easily left in the vial cap. Accordingly, when there is a possibility that the cover has come off (or has been detached from) the cap main body at a stage prior to use, such as a stage in the distribution process, and the stopper for a vial has been contaminated, the fact can easily be recognized, which is advantageous in terms of product quality and safety.

Hereinafter, a vial cap according to an embodiment of the present invention will be described in detail with reference to accompanying drawings for describing representative and specific examples of the vial cap according to the present embodiment. However, the present invention is not limited to the following embodiments. In addition, the same reference signs are provided to the members of the same structure, and the description of the members may be omitted.

As illustrated in FIG. 1 or FIG. 4, a vial cap 1 is an article to be attached to a mouth portion 72 of a vial 70 to fix a stopper 74 fitted into the mouth portion 72 so that the stopper 74 may not come off the mouth portion 72. As illustrated in FIG. 1 or FIG. 4, the vial cap 1 includes a cap main body 8 and a cover 40 as a constituent member.

[1] Cap Main Body:

As illustrated in FIG. 2A or FIG. 5A, the cap main body 8 is a member having: a top face portion 4 formed at an upper end of a tubular portion 2; and an upper opening 6 formed at the center of the top face portion 4 and penetrating the top face portion.

[1-1] Tubular Portion:

As illustrated in FIG. 2A or FIG. 5A, the tubular portion 2 is formed in a hollow tubular shape and is a portion that covers the mouth portion 72 (lip) of the vial 70 which is illustrated in FIG. 1 and into which the stopper 74 is fitted.

[1-1A] Entire Shape:

It is preferable that the inner diameter of the tubular portion be formed so as to be about the same as the outer diameter of the mouth portion of a vial and the outer diameter of a stopper or larger than the outer diameter of the mouth portion of a vial and the outer diameter of a stopper to make it possible to cover the mouth portion of a vial with the tubular portion. In the case where the outer diameter of the mouth portion of a vial is 20.0 mm, it is preferable that the inner diameter of the tubular portion be formed to be 19.7 to 21.0 mm although that depends on the size of the vial. For example, the inner diameter of the tubular portion 2 illustrated in FIG. 2A or FIG. 5A is formed to be 20.2 mm, which is larger than the outer diameter (20.0 mm) of the mouth portion 72 of the vial 70 illustrated in FIG. 1 and the outer diameter (19.0 mm) of the stopper 74.

The shape and size of the tubular portion are not particularly limited as long as the tubular portion can cover the mouth portion of a vial into which a stopper is fitted. The shape of the tubular portion can be, for example, in a cylindrical shape, a square tubular shape, or a hexagonally tubular shape. The size of the tubular portion can be, for example, 10.0 to 50.0 mm (preferably 13.0 to 40.0 mm, and more preferably 14.0 to 32.0 mm) as the outer diameter and 5.0 to 50.0 mm (preferably 8.0 to 25.0 mm) as the height. The tubular portion 2 illustrated in FIG. 2A or FIG. 5A adopts a cylinder having an outer diameter of 24.9 mm and a height of 11.2 mm as a basic shape, but does not have a perfect cylindrical shape and planar portions are formed as if some portions on the outer circumferential side has been chipped off (rectangular portion on front side of tubular portion 2, etc.). Planar view of the tubular portion 2 from above shows that a planar portion is formed at every 90° around the central axis of the tubular portion 2, namely four planar portions are formed in total.

[1-1B] Fixing Mechanism:

It is preferable that the tubular portion have a fixing mechanism to fix a stopper fitted into a mouth portion of a vial so that the stopper may not come off the mouth portion. The structure of the fixing mechanism is not particularly limited. Examples of the fixing mechanism include a claw and a projection (such as pin and protruded portion) which are formed on the inner circumferential side of the tubular portion and which engage with a mouth portion (lip) of the vial.

In the cap main body 8 illustrated in FIG. 1 or FIG. 4, the tubular portion has as a fixing mechanism a claw portion 20 protruding from the inner circumferential surface. The claw portion 20 is an approximately plate-shaped portion made of the same material as the tubular portion, and functions as a plate spring because of its flexibility. Accordingly, when the mouth portion of a vial into which a stopper is fitted is covered with a vial cap and the vial cap is pushed toward the mouth portion, the claw portion is first brought into contact with the mouth portion (lip) of the vial to be subjected to elastic deformation and the tip side of the claw portion is forced to extend toward the outer circumferential side of the tubular portion. When the vial cap is further pushed in that situation, the claw portion that has been elastically deformed gets over the lip completely and recovers the original shape, so that the vial cap 1 is attached to the mouth portion 72 of the vial 70 as illustrated in FIG. 1 or FIG. 4. In the state as illustrated in FIG. 1 or FIG. 4, the claw portion 20 of the vial cap 1 and the mouth portion 72 (lip) of the vial 70 are completely engaged, and therefore the stopper 74 fitted into the mouth portion 72 of the vial 70 is fixed so that the stopper 74 may not come off the mouth portion 72.

The shape, size, disposition, and the like of the claw portion are not particularly limited as long as the claw portion can be engaged with the mouth portion (lip) of a vial. Examples of the shape of the claw portion include a plate shape. In the plate-shaped claw portion, the thickness, width, angle of inclination, interval between the tip of the claw portion and the inner circumferential surface of the tubular portion, constituent materials, or the like can appropriately be adjusted. By adjusting these conditions, the performance that attaching the vial cap to a vial is relatively easy (load of about 50 to about 80 N) can be exhibited, and, further, a strong joining force such that after the vial cap is once attached to the vial, the vial cap can never be detached from the vial by pulling force of a person or so can also be exhibited.

In the case where the outer diameter of the mouth portion of a vial is 20.0 mm, the thickness of the claw portion can appropriately be adjusted within a range of 0.5 to 3.0 mm (preferably 0.8 to 2.0 mm), the width within a range of 5.0 to 10.0 mm (preferably 3.0 to 8.0 mm), the angle of inclination within a range of 20 to 60° (preferably 30 to 50°), and the interval between the tip of the claw portion and the inner circumferential surface of the tubular portion within a range of 1.0 to 5.0 mm (preferably 2.0 to 4.0 mm) although these depend on the size of the vial. The claw portion 20 illustrated in FIG. 1 or FIG. 4 is approximately plate-shaped and has a thickness of 1.2 mm and a width of 5.0 mm, the angle of inclination is formed to be 40° to the inner circumferential surface of the tubular portion, and the interval between the tip of the claw portion and the inner circumferential surface of the tubular portion is set to 3.7 mm.

The tubular portion illustrated in FIG. 1 or FIG. 4 has four claw portions 20. The claw portion 20 is formed so as to extend toward the direction of the central axis of the tubular portion from the inner circumferential surface of the tubular portion. The four claw portions 20 are disposed at rotationally symmetrical positions inside the tubular portion. That is, planar view of the tubular portion from above shows that a claw portion 20 is disposed at every 90° based on the central axis of the tubular portion 2. The diameter of an inscribed circle formed by connecting the tips of the four claw portions 20 is 15.8 mm, which is formed to be smaller than the outer diameter (20.0 m) of the mouth portion 72 of the vial 70 and the outer diameter (19.0 mm) of the stopper 74.

[1-1C] Others:

The shape of the tubular portion is not limited to the above-described shape and can appropriately be changed according to the purpose. For example, unevenness for hooking fingers may be provided at the outer circumferential surface of the tubular portion to make it easy to grasp the tubular portion with fingers although the unevenness is not illustrated in figures. Moreover, a slit that penetrates the tubular portion may be formed in the tubular portion to make it possible to check from outside the tubular portion whether a stopper is fitted without fail or not.

[1-2] Top Face Portion:

As illustrated in FIG. 2A or FIG. 5A, the top face portion 4 is a portion formed at the upper end of the tubular portion 2 and having the upper opening 6 formed at the center of the top face portion, the upper opening penetrating the top face portion 4.

[1-2A] Upper Opening:

As illustrated in FIG. 2A or FIG. 5A, the upper opening 6 is an opening formed at the center of the top face portion 4 and penetrating the tope face portion 4. The upper opening has a function as a window which exposes a portion (such as central portion) of a stopper fitted into the mouth portion of a vial. When the upper opening is formed, once the cover covering the upper opening is removed, the stopper fitted into the mouth portion of a vial is exposed through the upper opening to make it possible to pierce an injection needle or a spike needle through the stopper with the cap main body attached to the vial.

The shape and size of the upper opening are not particularly limited as long as a stopper can be exposed at the time of use through the upper opening and an injection needle or a spike needle can be pierced through the stopper. The shape observed by planar view of the upper opening from above is not necessarily a circular shape and may be, for example, a polygonal shape. Moreover, the inner diameter of the upper opening may be the same or may vary from the upper end of the opening to the lower end of the opening.

The upper opening 6 illustrated in FIG. 2A or FIG. 5A is formed so that the inner diameter may gradually become small from the upper end of the opening toward the lower end of the opening. That is, the inner space of the upper opening 6 is formed in an inverted truncated cone shape (earthen ware mortar shape). Such a shape is preferable in that when the surface of a stopper is wiped and sterilized with adsorbent cotton or the like before piercing an injection needle or a spike needle through the stopper, a portion that has been left not wiped is hard to occur. The upper opening 6 illustrated in FIG. 2A or FIG. 5A is formed to have an inner diameter of 9.3 mm at the upper end of the opening and an inner diameter of 6.5 mm at the lower end of the opening.

[1-2B] Entire Shape:

The shape and size of the top face portion are not particularly limited except that the top face portion is formed at an upper end of the tubular portion and that an upper opening penetrating the top face portion is formed at the center of the top face portion.

The top face portion 4 illustrated in FIG. 2A or FIG. 5A is configured by: a ring portion 16 in an approximately circular ring shape, the ring portion being a peripheral edge portion of the upper opening 6; and a bridge portion 18 connecting the tubular portion 2 and the ring portion 16. The top face portion 4 has four bridge portions 18. Planar view of the bridge portion 18 from above shows that the bridge portion is formed so that it may extend on all sides (in a cross shape) from the outer edge of the ring portion 16. That is, planar view of the top face portion 4 from above shows that a bridge portion 18 is disposed at every 90° based on the central axis of the tubular portion 2. Moreover, each bridge portion 18 is formed so that the shape observed by planar view from above may be partially circular ring-shaped (shape formed by cutting portion of circular ring). Furthermore, each bridge portion 18 protrudes upward from the upper end of the tubular portion 2, then extends in a horizontal direction toward the center of the tubular portion 2, and is connected to the outer edge of the ring portion 16. That is, each bridge portion 18 is formed so that the shape observed by planar view from the lateral may be inverted L-shaped.

The ring portion 16 is formed so as to have an approximately circular ring shape having an outer diameter of 15.4 mm, an inner diameter of the upper end of 9.3 mm, and an inner diameter of the lower end of 6.5 mm. Moreover, the shape observed by planar view of each bridge portion 18 from above is a partially circular ring shape formed by cutting out a circular ring having an outer diameter of 22.6 mm and an inner diameter of 15.4 mm in a range of 36° in terms of the central angle. Furthermore, the bridge portion 18 is formed so that the height from the upper end of the tubular portion 2 to the top face (excluding first protruding portion 24) of the bridge portion 18 may be 2.2 mm.

However, a bridge portion having a shape capable of connecting the ring portion and the tubular portion is sufficient, and the shape of the bridge portion is not limited to the shape illustrated in Figures. For example, the shape observed by planar view from above may be an approximately rectangular shape or the like, or may be a linear shape such that the bridge portion extends in a horizontal direction toward the center of the tubular portion directly from the upper end portion of the tubular portion without protruding upward from the upper end of the tubular portion.

It is to be noted that in the cap main body 8 illustrated in FIG. 2A or FIG. 5A, portions between one bridge portion 18 and another bridge portion 18 are penetration portions 22 penetrating the top face portion 4. However, the penetration portions are not necessarily formed in the top face portion, and the cap main body may have a shape such that portions other than the upper opening and pin-receiving holes, which will be mentioned later, are completely closed.

[1-2C] Pin-Receiving Holes:

As illustrated in FIG. 2A or FIG. 5A, a plurality of pin-receiving holes 10 penetrating the top face portion 4 are formed in the top face portion 4. As illustrated in FIG. 1 or FIG. 4, the pin-receiving holes are for accommodating fixing pins 46 of the cover 40 and are combined with the fixing pins 46 to have a function of firmly joining the cap main body 8 and the cover 40.

The number of pin-receiving holes is not particularly limited as long as the number is plural, and the pin-receiving holes may be formed so as to correspond to the disposition of fixing pins in the number equal to or larger than the number of fixing pins. In the cap main body 8 illustrated in FIG. 2A or FIG. 5A, a pin-receiving hole 10 is formed for each of the four bridge portions 18 of the cap main body 8, and planar view from above shows that a pin-receiving hole is formed at every 90° to the central axis of the tubular portion 2, namely four pin-receiving holes in total are formed.

[2] Cover:

As illustrated in FIG. 3A or FIG. 6A, the cover 40 is a member having: a disk-shaped cover main body 42; and a plurality of fixing pins 46 protruding downward from the lower face of the cover main body 42.

[2-1] Cover Main Body:

As illustrated in FIG. 3A or FIG. 6A, the cover main body 42 is a disk-shaped member. As illustrated in FIG. 1 or FIG. 4, the cover main body of the cover 40 has a function of covering the upper opening 6 of the cap main body 8.

It is preferable that the outer diameter of the cover main body be formed so as to be larger than the maximum outer diameter of the upper opening to make it possible to cover the upper opening of the cap main body. For example, the outer diameter of the cover main body 42 illustrated in FIG. 3A or FIG. 6A is formed so as to be 24.9 mm, which is larger than the maximum diameter (9.3 mm) of the upper opening 6 of the cap main body 8 illustrated in FIG. 1 or FIG. 4.

The shape and size of the cover main body are not particularly limited as long as the cover main body can cover the upper opening of the cap main body. The shape of the cover main body can be, for example, a disk shape or the like.

The disk-shaped cover main body 42 illustrated in FIG. 3A or FIG. 6A has four tooth-shaped portions 54 near the outer edge thereof, and each of the four tooth-shaped portions protrudes downward from the lower face of the cover main body 42. Planar view of the four tooth-shaped portions 54 from below shows that a tooth-shaped portion 54 is disposed at every 90° based on the central axis of the cover main body 42. Moreover, four tooth-shaped portions 54 are disposed in a partially circular ring shape, and their disposed positions are rotated by 45° to the disposed positions of four fixing pins 46. The cover main body 42 is formed so as to have an outer diameter of 24.9 mm and a thickness of 1.0 mm. Each tooth-shaped portion 54 is formed in a range of 36° based on the central axis of the cover main body 42, and each tooth-shaped portion has a thickness of 2.0 mm and a height of 2.2 mm.

[2-2] Fixing Pins:

As illustrated in FIG. 3A or FIG. 6A, the cover main body 42 has a plurality of fixing pins 46 each protruding downward from the lower face 44 of the cover main body 42. As illustrated in FIG. 1 or FIG. 4, the fixing pins 46 are the pins to be inserted into the pin-receiving holes 10 of the cap main body 8 and are combined with the pin-receiving holes 10 to have a function of firmly joining the cap main body 8 and the cover 40.

The number of fixing pins is not particularly limited as long as the number is plural, and the fixing pins may be formed so as to correspond to the disposition of the pin-receiving holes of the cap main body in the number equal to or less than the number of pin receiving holes. In the cover 40 illustrated in FIG. 3A or FIG. 6A, each fixing pin 46 is disposed so as to be seen from a space between the four tooth-shaped portions 54 of the cover main body 42, and planar view from below shows that a fixing pin 46 is formed at every 90° to the central axis of the cover main body 42, namely four fixing pins are formed in total.

[3] Joining Structure:

In a vial cap according to an embodiment of the present invention, the pin-receiving holes 10 of the cap main body 8 and the fixing pins 46 of the cover 40 are paired as illustrated in FIG. 1 or FIG. 4, and each pin-receiving hole 10 and a fixing pin 46 paired with the pin-receiving hole are formed in complementary shapes. A plurality of fixing pins 46 of the cover 40 are accommodated in a plurality of pin-receiving holes 10 of the cap main body 8, and the cap main body 8 and the cover 40 are joined with the pin-receiving holes 10 and the fixing pins 46 engaged. In this way, the cap main body 8 and the cover 40 can be joined firmly by mechanically (structurally) engaging the pin-receiving holes 10 and the fixing pins 46. Accordingly, a situation in which the cover 40 comes off the cap main body 8 unintentionally at a stage prior to use can effectively be prevented.

The term "complementary shapes" means that a pin-receiving hole and a fixing pin that is paired with the pin-receiving hole have inverted shapes (namely, in relation of mold and molded product). Moreover, the term "engaged" means that the shape of the pin-receiving holes and the shape of the fixing pins get mixed up mutually to exhibit resistance force against the force for pulling out the fixing pins from the pin-receiving holes. The embodiment of the engagement is not particularly limited, and examples thereof include (1) screw types (full thread type, half thread type) (2) different diameter types (reverse taper type, bulge type, constriction type), and (3) twist types. Hereinafter, the forms of engagement will be described individually.

[3-1] Screw Types:

In a vial cap according to an embodiment of the present invention, it is preferable that the cap main body 8 and the cover 40 be joined with the pin-receiving holes 10 and the fixing pins 46 engaged in a screw-like manner as in the vial cap 1 illustrated in FIG. 1 (such embodiment is referred to as "screw type"). The term "screw-like" means a joining structure in which a screw thread and a screw groove are engaged. In the vial cap 1 illustrated in FIG. 1, a plurality of fixing pins 46 of the cover 40 are accommodated in a plurality of pin-receiving holes 10 of the cap main body 8, and the cap main body 8 and the cover 40 are joined with screw threads of the pin-receiving holes 10 and screw grooves of the fixing pins are engaged. However, the "screw-like" form is not limited to the embodiment illustrated in FIG. 1, and, for example, a structure in which screw grooves formed on the inner circumferential surface of the pin-receiving holes and screw threads formed on the outer circumferential surface of the fixing pins are engaged is also included.

The shape of a pin-receiving hole can be, for example, a shape such that a circular through hole whose opening portion has a circular shape in terms of planar view from above is adopted as a basic shape and a screw thread is protruded from the inner circumferential surface of the circular through hole. The size of the pin-receiving hole is not particularly limited, a hole having an inner diameter of 0.5 to 5.0 mm (preferably 0.8 to 3.0 mm), a length of 0.5 to 8.0 mm (preferably 2.0 to 6.0 mm) can be used as the pin-receiving hole. The pin-receiving hole 10 illustrated in FIG. 2B has a shape such that a circular through hole whose opening portion has a circular shape in terms of planar view from above, the circular through hole having an inner diameter of 1.0 mm and a length of 4.4 mm, is adopted as a basic shape and a screw thread 14 is protruded from the inner circumferential surface 12 (width of 0.5 mm, height of 0.2 mm) of the circular through hole.

On the other hand, the shape of a fixing pin can be, for example, a shape such that a columnar pin whose end face has a circular shape in terms of planar view from below is adopted as a basic shape and a screw groove is formed on the outer circumferential surface of the columnar pin. In the fixing pin 46 illustrated in FIG. 3B, a screw groove 50 (width of 0.5 mm, depth of 0.2 mm) is formed on the outer circumferential surface 48 of a columnar pin (outer diameter of 1.8 mm, length of 2.2 mm) whose end face has a circular shape in terms of planar view from below.

In the cap main body 8 illustrated in FIG. 2A, each pin-receiving hole 10 has a plurality of semi-spiral screw threads 14 each protruding from the inner circumferential surface 12 thereof are formed as illustrated in FIG. 2B. On the other hand, in the cover 40 illustrated in FIG. 3A, each fixing pin 46 has a plurality of semi-spiral screw grooves 50 formed on the outer circumferential surface 48 thereof as illustrated in FIG. 3B. In general, a "spiral" is a curve obtained by winding a straight line to a column with a certain inclination (angle). The "semi-spiral" as referred to in the present specification means a spiral in which the number of winding the straight line (corresponding to screw thread or screw groove) to the column (number of rotations of spiral) is within a half-rotation among the spirals.

The inclination (angle of screw thread <or screw groove> to central axis of pin-receiving hole <or fixing pin>) is not particularly limited. When the inclination is made large, a screw thread and a screw groove are strongly engaged, so that the joining strength between the cap main body and the cover becomes high. On the other hand, when the inclination is made excessively large, it becomes difficult to detach the cover from the cap main body at the time of use. From such a point of view, it is preferable that the angle of inclination be 1 to 45°, more preferably 5 to 30°, and still more preferably 5 to 15°. The screw thread 14 illustrated in FIG. 2B is formed to be a semi-spiral shape having an inclination (angle) of 10° to the central axis of the pin-receiving hole 10. On the other hand, the screw groove 50 illustrated in FIG. 3B is formed to be a semi-spiral shape having an inclination (angle) of 10° to the central axis of the fixing pin 46.

The number of screw threads or screw grooves is not particularly limited as long as the number is plural; however, it is preferable that the number be 2 to 4. Moreover, it is preferable that the screw threads be disposed at rotationally symmetrical positions around the central axis of a pin-receiving hole, and it is preferable that the screw grooves be disposed at rotationally symmetrical positions around the central axis of a fixing pin. That is, it is preferable that n screw threads (or screw grooves) be each disposed at every (360/n°). Examples of the disposition include an embodiment in which a screw thread (or screw groove) is disposed at every 180° (two screw threads or screw grooves in total), at every 120° (three screw threads or screw grooves in total), or at every 90° (four screw threads or screw grooves in total). In the pin-receiving hole 10 illustrated in FIG. 2B, two screw threads 14 are formed. The two screw threads 14 are disposed at positions opposed to each other with the central axis of the pin-receiving hole 10 therebetween. That is, the two screw threads 14 are each disposed at every 180° based on the central axis of the pin-receiving hole 10. On the other hand, two screw grooves 50 are formed in the fixing pin 46 illustrated in FIG. 3B. The two screw grooves 50 are disposed at positions opposed to each other with the central axis of the fixing pin 46 therebetween. That is, the two screw grooves 50 are each disposed at every 180° based on the central axis of the fixing pin 46.

In FIG. 2C, a virtual line that connects two screw threads 14 is shown as a dashed line to make it easy to find the positions of two screw threads 14 of each pin receiving hole 10. Moreover, in FIG. 3C, a virtual line that connects two screw grooves 50 is shown as a dashed line to make it easy to find the positions of two screw grooves 50 of each fixing pin 46.

In the cap main body 8 illustrated in FIG. 2C, the screw threads 14 of the four pin-receiving holes 10 are each formed at a position rotated around the central axis of each pin-receiving hole 10 to the position of forming a screw thread 14 of another pin-receiving hole 10. As a result, the dispositions of screw threads 14 viewed from a direction of the opening of the pin-receiving holes 10 are all different in the four pin-receiving holes 10. Moreover, in the cover 40 illustrated in FIG. 3C, the screw grooves 50 of the four fixing pins 46 are each formed at a position rotated around the central axis of each fixing pin 46 to the position of forming a screw groove 50 of another fixing pin 46. As a result, the dispositions of screw grooves 50 viewed from a direction of an end portion of the fixing pins 46 are all different in the four fixing pins 46. However, such configuration is not essential in the present invention. That is, in a vial cap according to an embodiment of the present invention, the position of forming screw threads of each pin-receiving hole may be the same as or different from the position of forming screw threads in another pin-receiving hole. In the same manner, the position of forming screw grooves of each fixing pin may be the same as or different from the position of forming screw grooves of another fixing pin.

In addition, "the dispositions of the screw threads viewed from a direction of the opening of the pin-receiving holes are different" means that when the shape observed by planar view from the direction of the opening of a first pin-receiving hole and that of a second pin-receiving hole are assumed to be superimposed and observed in a perspective way, the screw threads in the first pin-receiving hole and the screw threads in the second pin-receiving hole are not superimposed and the shapes of the screw threads are not consistent. Moreover, "the dispositions of the screw grooves viewed from a direction of the end portion of the fixing pins are different" means that when the shape observed by planar view from the direction of the end portion of a first fixing pin and that of a second fixing pin are assumed to be superimposed and observed in a perspective way, the screw grooves in the first fixing pin and the screw grooves in the second fixing pin are not superimposed and the shapes of the screw grooves are not consistent.

In the vial cap 1 illustrated in FIG. 1, the screw threads 14 are formed in the whole area in the depth direction of a pin-receiving hole 10 as illustrated in FIG. 2B, and the screw grooves 50 are formed in the whole area in the length direction of a fixing pin 46 as illustrated in FIG. 3B (such embodiment is referred to as "full thread type"). However, in a vial cap according to an embodiment of the present invention, it is also preferable that the pin-receiving hole has a shape such that the screw threads are formed on the lower end side and the screw threads are not formed on the upper end side, and the fixing pin has a shape such that the screw grooves are formed on the tip side and the screw grooves are not formed on the end side (such embodiment is referred to as "half thread type").

For example, the fixing pin 46 illustrated in FIG. 7A has a shape such that the screw grooves 50 are formed only on the tip side of the fixing pin 46 and the screw grooves 50 are not formed on the end side of the fixing pin 46. The half thread type joining structure has less engaged portion of a screw thread and a screw groove and larger free portion where a fixing pin is not restricted by a pin-receiving hole than the full thread type joining structure and therefore has a characteristic that the resistance force against the force for pulling out the fixing pins from the pin-receiving holes is smaller when compared with that of the full thread type. Accordingly, the half thread type joining structure is advantageous in that a situation that the cover comes off the cap main body at a stage prior to use can effectively be prevented and the cover can easily be detached at the time of use.

[3-2] Different Diameter Types:

In a vial cap according to an embodiment of the present invention, it is preferable that the pin-receiving holes each have a shape such that an inner diameter thereof changes, the fixing pins each have a shape such that an outer diameter thereof changes, and the cap main body and the cover be joined with the maximum portion of the inner diameter of the pin-receiving holes and the maximum portion of the outer diameter of the fixing pins engaged, or with the minimum portion of the pin-receiving holes and the minimum portion of the outer diameter of the fixing pins engaged (such embodiment is referred to as "different diameter type").

That "the inner diameter changes" means that the inner diameter of the pin-receiving hole is not constant and the inner diameter of the hole is extended and/or contracted toward the depth direction of the hole. On the other hand, that "the outer diameter changes" means that the outer diameter of the fixing pin is not constant and the outer diameter of the pin is extended and/or contracted toward the length direction of the pin. The different diameter types are classified into, for example, a reverse taper type, a bulge type, and a constriction type according to the shape of the fixing pin. Hereinafter, respective types will be described individually.

[3-2A] Reverse Taper Type:

In a vial cap according to an embodiment of the present invention such as, for example, the vial cap 1 illustrated in FIG. 4, it is preferable that the pin-receiving holes 10 each have a shape such that the inner diameter at a lower end is maximum and the inner diameter becomes smaller as the inner diameter approaches an upper end and the fixing pins 46 each have a shape such that the outer diameter at a tip portion is maximum and the outer diameter becomes smaller as the outer diameter approaches an end side (such embodiment is referred to as "reverse taper type").

In the reverse taper type, the specific shapes of the pin receiving hole and the fixing pin are not particularly limited as long as the fixing pin is club-shaped and the pin-receiving hole is formed in a shape that is complementary to the fixing pin. The vial cap 1 illustrated in FIG. 4 is an example in which the fixing pins 46 are each formed in a truncated cone shape as illustrated in FIG. 6A and FIG. 6B. However, the shape of the fixing pins in the reverse taper type is not limited to the truncated shape as shown in FIGS. 6A and 6B. For example, the shape of the fixing pin may be a truncated pyramid shape such as a triangular pyramid shape or a square pyramid shape. For example, the fixing pin 46 illustrated in FIG. 7B is formed in a square pyramid shape.

It is preferable that the taper angle θ of the fixing pin be 1° or more and 20° or less in the reverse taper type. By setting the taper angle θ to 1° or more, an effect of engaging pin-receiving holes and fixing pins can be obtained. On the other hand, by setting the taper angle θ to 20° or less, the trouble that the end portion of the fixing pins has a small diameter to lower the mechanical strength of the portion can be prevented. The fixing pins 46 illustrated in FIG. 4, FIG. 6A, and FIG. 6B are each formed so as to have a length of 2.2 mm and a taper angle θ of about 2.6°. The minimum diameter and the maximum diameter of a fixing pin is not particularly limited; however, it is preferable the minimum diameter of a fixing pin be 0.5 mm ϕ or more and 1.0 mm ϕ or less and the maximum diameter of a fixing pin be 0.6 mm ϕ or more and 3.0 mm ϕ or less in the case of a vial cap for a 10 mL vial. The vial cap 1 illustrated in FIG. 4 is a vial cap for a 10 mL vial, and the fixing pins 46 are each formed so as to have a minimum diameter (outer diameter of end portion) of 0.8 mm ϕ, a maximum diameter (outer diameter of tip portion) of 1.0 mm ϕ, and a difference of the maximum diameter and the minimum diameter of 0.2 mm.

[3-2B] Bulge Type:

In a vial cap according to an embodiment of the present invention, it is preferable that the pin-receiving holes each have a shape such that the maximum portion of the inner diameter exists halfway in a depth direction, and the fixing pins each have a shape such that the maximum portion (bulge portion) of the outer diameter exists halfway in a length direction (such embodiment is referred to as "bulge type"). For example, the fixing pin 46 illustrated in FIG. 7C has a shape such that a column is adopted as a basic shape and the maximum portion (bulge portion) 46*c* of the outer diameter exists at the center in the length direction.

In the bulge type, it is preferable that the maximum diameter of a fixing pin be 1.2 times or more and 3.0 times or less as large as the minimum diameter. By setting the maximum diameter to 1.2 times or more, the effect of engaging pin-receiving holes and fixing pins can be obtained. On the other hand, by setting the maximum diameter to 3.0 times or less, the trouble that the end portion of the fixing pins has a small diameter to lower the mechanical strength of the portion can be prevented. The fixing pin 46 illustrated in FIG. 7C has a length of 2.2 mm, a minimum diameter (outer diameter of tip portion and end portion) of 0.8 mm ϕ, a maximum diameter (outer diameter of bulge portion 46*c*) of 1.2 mm ϕ, and the maximum diameter of the fixing pin 46 is 1.5 times as large as the minimum diameter.

[3-2C] Constriction Type:

In a vial cap according to an embodiment of the present invention, it is preferable that the pin-receiving holes each have a shape such that the minimum portion of the inner diameter exists halfway in a depth direction, and the fixing pins each have a shape such that the minimum portion (constriction portion) of the outer diameter exist halfway in a length direction (such embodiment is referred to as "constriction type"). For example, the fixing pin 46 illustrated in FIG. 7D has a shape such that a column is adopted as a basic shape, and the minimum portion (constriction portion) 46*d* of the outer diameter exists at the center in the length direction.

In the constriction type, it is preferable that the minimum diameter of the fixing pins be 40% or more and 80% or less of the maximum diameter. By setting the minimum diameter to 80% or less, the effect of engaging pin-receiving holes and fixing pins can be obtained. On the other hand, by setting the minimum diameter to 40% or more, the trouble that the constriction portion of the fixing pins has a small diameter to lower the mechanical strength of the portion can be prevented. The fixing pin 46 illustrated in FIG. 7D has a length of 2.2 mm, a minimum diameter (outer diameter of constriction portion 46*d*) of 0.8 mm ϕ and a maximum diameter (diameter of tip portion and end portion) of 1.2 mm ϕ, and the minimum diameter of the fixing pin 46 is 67% of the maximum diameter.

[3-3] Twist Types:

In a vial cap according to an embodiment of the present invention, it is preferable that the pin-receiving holes each have a shape having a twisted polygonal columnar inner space, and the fixing pins each have a twisted polygonal columnar shape (such embodiment is referred to as "twist type"). The "twisted polygonal column" means a three-dimensional shape obtained by rotating two bottom faces of a polygonal column to be a basic shape around the axis in reverse directions (in a twisted manner). Examples of the polygonal column to be a basic shape include polygonal columns such as a triangular column, a quadrangular column, and polygonal columns such that the shape of the bottom face is a star-shaped polygon. Examples of the star-shaped polygon include a five-pointed star shape and a six-pointed star shape.

For example, the fixing pin 46 illustrated in FIG. 7E has a twisted quadrangular column shape obtained by rotating two bottom faces of a quadrangular column to be a basic shape around the axis in reverse directions (in a twisted manner). It is preferable that the twisted angle be 3° or more and 50° or less. By setting the twisted angle to 3° or more, the effect of engaging pin-receiving holes and fixing pins can be obtained. On the other hand, by setting the twisted angle to 50° or less, the trouble that the twisted angle is excessively large and the central portion in the length direction of the fixing pin has a small diameter to lower the mechanical strength at the portion can be prevented. The fixing pin 46 illustrated in FIG. 7E has a length of 2.2 mm and a twisted angle of 45°.

In addition, the strength with which the cover does not come off during pharmaceutical process, sterilization, or transportation is required for the cover of a vial cap, while the cover is required to be easily removable to such an extent that the operability in medical settings is not lost. Specifically, the upper limit of the strength against coming-off of a cover of a vial cap is specified in ISO 8362-6, and it has been established that the strength against coming-off that exceeds the upper limit cannot be set. In this regard, the embodiments such as screw types (full thread type, half thread type), different diameter types (reverse taper type, bulge type, constriction type), and twist types have excellent characteristics that the strength against coming-off of a cover can easily be adjusted by appropriately adjusting the screw angle, the difference (gap) of diameters at different diameter portions, the twisted angle, and the like In a vial cap according to an embodiment of the present invention, the pin-receiving holes and the fixing pins may further be adhered by thermal fusion bonding or the like as long as the pin-receiving holes and the fixing pins are engaged. Even though the pin-receiving holes and the fixing pins are subjected to thermal fusion bonding, the fused points occupy merely a part in the cap main body and the cover, and therefore the cover can easily be removed at the time of use. However, it is preferable that the cap main body and the cover be joined with the pin-receiving holes and the fixing pins being in a non-fused state from the viewpoint of easily removing the cover from the cap main body at the time of use. Moreover, in the case where the pin-receiving holes and the fixing pins are joined by mechanical engagement, the fixing pins are torn off or fractured when the cover is detached intentionally (or comes off unintentionally) irrespective of whether the pin-receiving holes and the fixing pins are in a thermally fused state or in a non-fused state. Moreover, even if the fixing pins are not torn off (or not fractured), the fixing pins are subjected to elastic deformation to begin to comes off the pin-receiving holes while being twisted, and when the fixing pins completely comes off the pin-receiving holes, the twisted state of the fixing pins are eliminated and the fixing pins return to the original state in a configuration of, for example, the "screw types", the "twist types", and the like. When an attempt to insert the fixing pins into the pin-receiving holes is made in this state, it finds difficult to attach the fixing pins again. Furthermore, in a configuration of the "different diameter types", when the cover is detached intentionally (or comes off unintentionally), the possibility that the fixing pins are fractured is higher, and the possibility that the fixing pins come off without being fractured is lower. However, in the case of the configuration of the "different diameter types", even if the fixing pins come off without being fractured, it is difficult to insert the fixing pins into the pin-receiving holes once the fixing pins come off the pin-receiving holes, making it difficult to join the cap main body and the cover due to the maximum portions and the minimum portions in the inner diameter of the pin-receiving holes and in the outer diameter of the fixing pins.

In this way, when there is a possibility that a stopper for a vial has been contaminated, the vial cap according to an embodiment of the present invention has a structure in which the trace is left (tamper evidence property, virgin sealing property) to easily grasp the fact and therefore is preferable in terms of product quality and safety. In addition, if both the pin-receiving holes and the fixing pins have a shape such as a straight shape and are not mutually engaged, and further if the pin-receiving holes and the fixing pins are not subjected to thermal fusion bonding, there is a possibility that the fixing pins come off the pin-receiving holes and can be attached to the pin-receiving holes again when the cover is detached intentionally (or come off unintentionally). In such a case, when there is a possibility that the cover has come off (or has been detached from) the cap main body at a stage prior to use of a vial and a stopper for a vial has been contaminated, it is difficult to recognize the fact.

[3-4] Fitting Structure of Portions Other Than Pin-Receiving Holes and Fixing Pins:

In addition, in the cap main body 8 illustrated in FIG. 2A, the first protruding portions 24 in a columnar shape each protruding upward from the top face of the bridge portion 18 are formed, and the pin-receiving holes 10 are each formed so as to penetrate the central portion of the first protruding portions 24. The first protruding portions 24 illustrated in FIG. 2A are each formed to be a columnar shape having an outer diameter of 1.8 mm, a height of protrusion from the top face of the bridge portion 18 of 0.5 mm.

On the other hand, in the cover 40 illustrated in FIG. 3A, the second protruding portions 56 in a cylindrical shape in which a portion of the disk-shaped cover main body 42 protrudes downward are formed, and the fixing pins 46 are each disposed inside the second protruding portion 56. The second protruding portions 56 illustrated in FIG. 3A are each formed to be a cylindrical shape having an outer diameter of 3.4 mm, an inner diameter of 2.0 mm, and a height of protrusion from the lower face 44 of the disk-shaped cover main body 42 of 0.5 mm.

The vial cap illustrated in FIG. 1 is formed so as to have a structure in which the first protruding portions 24 of the cap main body 8 illustrated in FIG. 2A and the second protruding portions 56 of the cover 40 illustrated in FIG. 3A are mutually fitted and the penetration portions 22 illustrated in FIG. 2A and the tooth-shaped portions 54 illustrated in FIG. 3A are mutually fitted. These fitting structures are combined with the engaging structure of the fixing pins and the pin-receiving holes to determine the position of the cover 40 to the cap main body 8, making it possible to exhibit an effect of fixing both the members not to deviate.

[4] Materials:

The material of the cap main body is not particularly limited as long as the material is a resin. However, a vial may be subjected to high-pressure steam sterilization with a stopper fitted thereto (namely, with cap attached to vial), and therefore it is preferable that the cap main body be formed with a heat-resistant resin that can tolerate a high-pressure steam sterilization condition of a temperature of 121° C. for 20 minutes. Examples of the heat-resistant resin that can tolerate a high-pressure steam sterilization condition a temperature of 121° C. for 20 minutes include polypropylene, polycarbonate, and polyacetal. Among the heat-resistant resins, polyacetal that is particularly excellent in heat resistance and shock resistance is preferable. All the portions of the cap main body 8 illustrated in FIG. 2A are formed with polyacetal.

The material of the cover is not particularly limited as well. Examples of the resin include polyethylene, polypropylene, polycarbonate, and polyacetal, and polypropylene is preferable among the resins. All the portions of the cover 40 illustrated in FIG. 3A are formed with polypropylene.

In a vial cap according to an embodiment of the present invention, it is preferable that the cap main body be formed with the first resin, the fixing pins be formed with the second resin, and the first resin be a resin that does not melt when the second resin in a molten state is brought into contact with the first resin. By selecting such resins, the fixing pins are not fused to the pin-receiving holes in the case where a vial cap according to an embodiment of the present invention is produced by a method such as two-color molding, which will be mentioned later. In this way, by making the fixing pins and the pin-receiving holes in a non-fused state, an effect of allowing the cover to have an appropriate strength against coming-off can be obtained.

The cap main body and the cover may be formed with the same kind of resin or with different resins. In the vial cap 1 illustrated in FIG. 1, the cap main body 8 is formed with polyacetal, and the cover 40 is formed with polypropylene. However, the kinds of resins are not limited to polyacetal and polypropylene.

[5] Production Process:

The process for producing a vial cap according to an embodiment of the present invention is not particularly limited. However, it is preferable to produce a vial cap according to an embodiment of the present invention by an injection molding method such as a two-color molding method or a DSI (Die Slide Injection) molding method, and, among others, it is particularly preferable to produce the vial cap by a two-color molding method. The vial cap according to an embodiment of the present invention has a structure in which fixing pins are engaged with pin-receiving holes, and therefore it is difficult to insert the fixing pins into the pin-receiving holes of the cap main body after the cover including the fixing pins is molded. However, the vial cap according to an embodiment of the present invention can be produced relatively easily by making use of an injection molding method such as a two-color molding method or a DSI molding method.

The two-color molding method (double molding method) is a kind of injection molding method and can be conducted using an injection molding machine provided with, for example, a common mold, a primary mold, a secondary mold, and a rotary table. The primary mold is combined with the common mold to form a cavity (primary cavity) for primary molding, the secondary mold is combined with the common mold to form a cavity (secondary cavity) for secondary molding, and the rotary table is a turntable on which the common mold is mounted and set to the primary mold or the secondary mold.

According to the two-color molding method, a vial cap according to an embodiment of the present invention can be produced by, for example, a method as described below.

(1) Primary Molding:

The primary cavity is first formed by combining the common mold and the primary mold. Molding pins to be a reverse mold of pin-receiving holes are set up in the primary cavity. The molding pins have the same shape as the fixing pins (for example, shape such that plurality of semi-spiral screw grooves are formed on outer circumferential surface of columnar pins). Furthermore, in the primary cavity, the molding pins are fixed so that the pins may not rotate around the axis or the molding pins are fixed in a state where the pins can freely rotate around the axis. When the primary molding is conducted in such a state, the position of forming a plurality of screw threads in the pin-receiving holes can be made the same, can be deviated to any position, or can be disposed at random positions.

Subsequently, a resin is injected (primary injection) into the primary cavity to conduct primary molding, thereby obtaining a primary molded product (cap main body). For example, polyacetal is injected into the primary cavity. When the primary molding is completed, the molding pins are detached from the primary molded product (cap main body). Thereby, pin-receiving holes are formed in the cap main body as a primary molded body.

(2) Secondary Molding:

The common mold holding the primary molded product (cap main body) therein is rotated with the rotary table, and the common mold holding the primary molded product and the secondary mold are combined to form a secondary cavity.

Subsequently, a resin is injected (secondary injection) into the secondary cavity to conduct secondary molding, thereby obtaining a secondary molded product (vial cap) in which the primary molded product (cap main body) and a cover are combined. For example, polypropylene is injected into the secondary cavity. When polypropylene is injected, the molding pins have been removed from the primary molded product (cap main body), so that the polypropylene flows into the pin-receiving holes of the primary molded product (cap main body) to mold fixing pins each having a shape that is complementary to the shape of the pin-receiving holes of the cap main body.

In the secondary molding, the cover main body is first molded, and subsequently fixing pins are molded. Polypropylene for forming fixing pins and polypropylene that forms the cover main body are the same material, and it is considered that the compatibility is high. Therefore, the fixing pins are firmly bonded (thermal fusion bonding) to the cover main body. On the other hand, polyacetal that forms the cap main body does not melt when polypropylene in a molten state is brought into contact with the polyacetal, and therefore the fixing pins are not bonded to the pin-receiving holes of the cap main body by thermal fusion bonding. That is, the pin-receiving holes of the cap main body and the fixing pins of the cover are in a non-fused stated and the cap main body and the cover are joined only by mechanical engagement.

Respective formations described in the description of the vial cap according to an embodiment of the present invention can be configured by arbitrarily combining them. For example, a vial cap according to an embodiment of the present invention includes a plurality of pin-receiving holes provided in the cap main body and a plurality of fixing pins provided in the cover and therefore can be configured by arbitrarily combining the embodiments of the engagement of pin-receiving holes and fixing pins. Moreover, for example, a configuration in which pin-receiving holes and fixing pins are partially bonded by thermal fusion bonding or a configuration in which pin-receiving holes and fixing pins are in a non-fused state can be adopted for each embodiment of the engagement of pin-receiving holes and fixing pins.

INDUSTRIAL APPLICABILITY

A vial cap according to an embodiment of the present invention prevents a stopper for a vial from coming off and therefore can be utilized as a resin vial cap to be attached to a mouth portion of the vial. Particularly, the vial cap can suitably be utilized as a vial cap for vials for pharmaceutical products for which extremely strict quality control is required. Moreover, the vial cap can suitably be used as a vial cap for vials, such as a vial for an injection solution and a vial for a transfusion preparation, for which taking out the content by sticking an injection needle or a spike needle through a stopper without removing the stopper is required.

REFERENCE SIGNS LIST

1 Vial cap
2 Tubular portion

4 Top face portion
6 Upper opening
8 Cap main body
10 Pin-receiving hole
12 Inner circumferential surface
14 Screw thread
16 Ring portion
18 Bridge portion
20 Claw portion
22 Penetration portion
24 First protruding portion
40 Cover
42 Cover main body
44 Lower face
46 Fixing pin
48 Outer circumferential surface
50 Screw groove
54 Tooth-shaped portion
56 Second protruding portion
70 Vial
72 Mouth portion
74 Stopper

The invention claimed is:

1. A resin vial cap to be attached to a mouth portion of a vial to fix a stopper fitted into the mouth portion so that the stopper may not come off the mouth portion, the vial cap comprising:

a cap main body; and a cover, the cap main body comprising:

a top face portion formed at an upper end of a tubular portion;

an upper opening formed at a center of the top face portion and penetrating the top face portion; and a plurality of pin-receiving holes formed at the top face portion and penetrating the top face portion, and the cover covering the upper opening of the cap main body and comprising:

a plate-shaped cover main body; and a plurality of fixing pins protruding downward from a lower face of the cover main body, wherein:

the pin-receiving holes of the cap main body and the fixing pins of the cover are paired, and each of the pin-receiving holes and one of the fixing pins paired with one of the pin-receiving holes are formed in complementary shapes, the plurality of the fixing pins of the cover are accommodated in the plurality of the pin-receiving holes of the cap main body, and the cap main body and the cover are joined with the pin-receiving holes and the fixing pins engaged.

2. The vial cap according to claim 1, wherein:

the cap main body is formed with a first resin, the fixing pins are formed with a second resin, and the first resin is a resin that does not melt when the second resin in a molten state is brought into contact with the first resin.

3. The vial cap according to claim 1, wherein:

the cap main body is formed with polyacetal, and the fixing pins are formed with polypropylene.

4. The vial cap according to claim 1, wherein the cap main body and the cover are joined with the pin-receiving holes and the fixing pins engaged in a screw-like manner.

5. The vial cap according to claim 4, wherein:

a plurality of semi-spiral screw threads each protruding from an inner circumferential surface of each of the pin-receiving holes are formed, a plurality of semi-spiral screw grooves are formed on an outer circumferential surface of each of the fixing pins, and the cap main body and the cover are joined with the screw threads of the pin-receiving hole and the screw grooves of the fixing pin engaged.

6. The vial cap according to claim 5, wherein:

the pin-receiving hole has a shape such that the screw threads are formed on a lower end side thereof and the screw threads are not formed on an upper end side thereof, and the fixing pin has a shape such that the screw grooves are formed on a tip side thereof and the screw grooves are not formed on an end side thereof.

7. The vial cap according to claim 1, wherein:

the pin-receiving holes each have a shape such that an inner diameter thereof changes, the fixing pins each have a shape such that an outer diameter thereof changes, and the cap main body and the cover are joined with a maximum portion of the inner diameter of the pin-receiving holes and a maximum portion of the outer diameter of the fixing pins engaged, or with a minimum portion of the inner diameter of the pin-receiving holes and a minimum portion of the outer diameter of the fixing pins engaged.

8. The vial cap according to claim 7, wherein:

the pin-receiving holes each have a shape such that the inner diameter at a lower end thereof is maximum, and the inner diameter becomes smaller as the inner diameter approaches an upper end thereof, and the fixing pins each have a shape such that the outer diameter at a tip portion thereof is maximum, and the outer diameter becomes smaller as the outer diameter approaches an end side thereof.

9. The vial cap according to claim 7, wherein:

the pin-receiving holes each have a shape such that the maximum portion of the inner diameter exists halfway in a depth direction thereof, and the fixing pins each have a shape such that the maximum portion of the outer diameter exists halfway in a length direction thereof.

10. The vial cap according to claim 7, wherein:

the pin-receiving holes each have a shape such that the minimum portion of the inner diameter exists halfway in a depth direction thereof, and the fixing pins each have a shape such that the minimum portion of the outer diameter exists halfway in a length direction thereof.

11. The vial cap according to claim 1, wherein the pin-receiving holes each have a shape having a twisted polygonal columnar inner space, and the fixing pins each have a twisted polygonal columnar shape.

* * * * *